US010441487B1

(12) United States Patent
Jerome-Miller et al.

(10) Patent No.: US 10,441,487 B1
(45) Date of Patent: Oct. 15, 2019

(54) SURGICAL RECOVERY PILLOW

(71) Applicant: Sleepeze, LLC, Tamarac, FL (US)

(72) Inventors: Stacey Jerome-Miller, Fort Lauderdale, FL (US); Ronald Anthony DeMarco, Fort Lauderdale, FL (US)

( * ) Notice: Subject to any disclaimer, the term of this patent is extended or adjusted under 35 U.S.C. 154(b) by 103 days.

(21) Appl. No.: 15/950,541

(22) Filed: Apr. 11, 2018

(51) Int. Cl.
*A61G 7/07* (2006.01)
*A47G 9/10* (2006.01)

(52) U.S. Cl.
CPC ..... *A61G 7/072* (2013.01); *A47G 9/10* (2013.01)

(58) Field of Classification Search
CPC ..... A47G 9/10; A47G 9/1054; A47G 2009/1018; A61G 7/072; A61G 13/121
USPC ..... D6/601
See application file for complete search history.

(56) References Cited

U.S. PATENT DOCUMENTS 4,908,893 A 3/1990 Smit
D337,914 S * 8/1993 McDonald ..... 5/638
5,848,448 A * 12/1998 Boyd ..... A47G 9/10 5/636
5,960,494 A * 10/1999 Gilliland ..... A61G 13/12 5/638
6,408,468 B1 6/2002 Comfort
D474,364 S 5/2003 Arcieri
6,629,324 B1 10/2003 Shapiro
D750,397 S * 3/2016 Werner ..... D6/601
9,289,082 B1 * 3/2016 White ..... A47G 9/10
D816,374 S * 5/2018 Potter ..... D6/601
2008/0155752 A1 * 7/2008 Fujita ..... A47G 9/10 5/636
2015/0040322 A1 * 2/2015 Cheng ..... A47G 9/1054 5/638

FOREIGN PATENT DOCUMENTS

JP 2003325270 A * 11/2003

* cited by examiner

*Primary Examiner* — Nicholas F Polito
(74) *Attorney, Agent, or Firm* — The Concept Law Group, PA; Scott M. Garrett; Scott D. Smiley

(57) ABSTRACT

A surgical recovery pillow can include one of more cutouts formed in the pillow body, at a top surface of the pillow body, that reduce or avoid pressure around the ear, eye, cheek, and upper neck regions of a user's face at the side of the user's face, when the user lays with their head properly positioned over a cutout. Each cutout is non-circular, and includes a support portion that extends from the pillow body into the cutout to support the user's head at the temple region of the user's head.

20 Claims, 7 Drawing Sheets

SURGICAL RECOVERY PILLOW

FIELD OF THE INVENTION

The present invention relates generally to pillows and, more particularly, relates to a surgical recovery pillow having pressure-relieving cutouts that relieve pressure around the eye and cheek region of a user's face, with a support portion formed between the eye and cheek relieving cutout portions.

BACKGROUND OF THE INVENTION

Patients who undergo facial and neck surgery are typically instructed to sleep facing supine, on their back, so as to avoid putting pressure, such as from contact with a conventional pillow, on their face and neck, and around the ear, where surgical incisions are typically made, and where affected tissue is located that needs to heal and recover. Similarly, it is thought that sleeping with pressure on the side of the face induces wrinkling of the skin around the eyes and other parts of the face. According, it is likewise recommended, to avoid producing wrinkles, to not sleep with the side of the face against a pillow. For some people sleeping on their back, facing up, can be difficult. Either it is uncomfortable, or they will fall asleep and roll to their side while asleep. In the case of surgical recover, this can be very undesirable as it can put stress on healing tissue, and prevents optimum healing from occurring.

This problem has been addressed to some degree but forming pressure-relieving cutouts or opening in a pillow that the user aligns with their ears when sleeping on their side. These cutouts or openings are generally circular, and sized for relieving pressure only around the ear. However, it is not uncommon for people who have surgery around their ear to also have surgery on other parts of their face, such around their eye. Simply making the openings larger does not work because a large circular cutout large enough to encompass both the ear and eye region does not provide support around other part of the face/head to be comfortable.

Therefore, a need exists to overcome the problems with the prior art as discussed above.

SUMMARY OF THE INVENTION

The invention provides a surgical recovery pillow having pressure-relieving cutouts that overcomes the hereinaforementioned disadvantages of the heretofore-known devices and methods of this general type and that provides relieved areas of the pillow, such as cutouts or depressions in the top surface of the pillow, that correspond to the eye, ear, and neck areas when a user is laying on their side, but which provides support formations that intrude into the depressions/cutouts to provide sufficient support for the user's head to keep the user comfortable as well.

With the foregoing and other objects in view, there is provided, in accordance with the invention, a facial surgery recovery pillow that includes a pillow body that has an outside edge around a perimeter of the pillow body. The pillow can further include a pair of cutouts formed at a top surface of the pillow body which extend from the top surface into the pillow body towards a bottom surface of the pillow body. The cutouts can be positioned symmetrically on the top surface with respect to each other. Each of the cutouts define a proximate side and a bottom side, with the proximate side and bottom side meeting at a vertex, and with the bottom side extending away from the proximate side towards an outside edge of the pillow body at an angle from a bottom edge of the pillow body. Each of the cutouts can further define a top lobe and a side lobe with a support portion of the pillow body extending in between the top lobe and the side lobe.

In accordance with another feature, an embodiment of the present invention includes the pair of cutouts being separated between their respective proximate sides by a distance of at least two inches.

In accordance with another feature, an embodiment of the present invention includes the pillow body being formed of a resilient foam.

In accordance with another feature, an embodiment of the present invention includes a distance from the respective vertex of each cutout to a lower outside side edge of the pillow body being less than a distance from the respective top lobe of each cutout to an upper outside edge of the pillow body.

In accordance with another feature, an embodiment of the present invention includes the distance from the respective vertex of each cutout to the lower outside edge of the pillow body being not more than two inches, and the distance from the respective top lobe of each cutout to the upper outside edge of the pillow body being more than two inches.

In accordance with another feature, an embodiment of the present invention includes each of the cutouts being substantially heart-shaped and which are symmetric about a line between a peak of the support portion and the vertex, and wherein the line between the peak of the support portion and the vertex is at an angle of between 40 and 50 degrees with respect to an axis about which the cutouts are symmetric.

In accordance with another feature, an embodiment of the present invention includes the top and bottom surfaces of the pillow body are rectangular.

In accordance with another feature, an embodiment of the present invention further includes a ventilation channel formed in the pillow body between at least one of the cutouts and an outer edge of the pillow body.

In accordance with another feature, an embodiment of the present invention includes the cutouts pass completely through the pillow body, from the top surface of the pillow body to the bottom surface of the pillow body.

In accordance with another feature, an embodiment of the present invention includes a surgical recovery pillow for facilitating healing of a user after facial and neck surgical procedures by avoiding pressure on portions of the user's face, the surgical recovery pillow includes a pillow body having an outside edge around a perimeter of the pillow body. The pillow body includes at least one cutout that is formed at a top surface of the pillow body and which extends from the top surface towards a bottom surface of the pillow body. The at least one cutout defines a proximate side and a bottom side, where the proximate side and bottom side meet at a vertex, and with the bottom side extending away from the proximate side towards an outside edge of the pillow body at an angle from a bottom edge of the pillow body. The at least one cutout further defining a top lobe and a side lobe with a support portion of the pillow body extending in between the top lobe and the side lobe, the top lobe having a position corresponding to an ear of the user, the side lobe having a position corresponding to an eye of the user, and the support portion having a position corresponding to a temple of the user, between the ear and eye of the user.

In accordance with another feature, an embodiment of the present invention includes a distance from the vertex of the at least one cutout to a lower outside side edge of the pillow body being less than a distance from the top lobe of the at least one cutout to an upper outside edge of the pillow body.

In accordance with another feature, an embodiment of the present invention includes the distance from the vertex of the at least one cutout to the lower outside edge of the pillow body being not more than two inches, and the distance from the top lobe of the at least one cutout to the upper outside edge of the pillow body being more than two inches.

In accordance with another feature, an embodiment of the present invention includes the at least one cutout being substantially heart-shaped and being symmetric about a line between a peak of the support portion and the vertex, and wherein the line between the peak of the support portion and the vertex is at an angle of between 40 and 50 degrees with respect to an axis from a top edge to a bottom edge of the pillow body along a line in the direction in which a person normally lies with respect to the surgical recovery pillow.

In accordance with another feature, an embodiment of the present invention further includes the surgical recovery pillow having a ventilation channel formed in the pillow body between the at least one cutout and an outer edge of the pillow body.

In accordance with another feature, an embodiment of the present invention includes the at least one cutout passes completely through the pillow body, from the top surface of the pillow body to the bottom surface of the pillow body.

In accordance with another feature, an embodiment of the present invention includes the at least one cutout comprises two cutouts that are positioned symmetrically on the top surface with respect to each other, wherein the two cutouts are separated between their respective proximate sides by a distance of at least two inches.

In accordance with another feature, an embodiment of the present invention includes a surgical recovery pillow including a pillow body formed of a resilient foam material having a top surface and a perimeter including side edges. Formed in the top surface are a pair of cutouts which are positioned symmetrically at the top surface of the pillow body. Each cutout having a main portion, a top lobe, and a side lobe. The top lobe being configured to correspond with a user's ear, the side lobe being configured to correspond with the user's eye, and the main portion being configured to correspond with the user's cheek and upper neck. Each of the cutouts is defined in part by a proximate side and a bottom side, where the proximate side of each cutout being substantially in line with a direction in which the user lays with respect to the surgical recovery pillow, and the bottom side meeting the proximate side at a vertex at a portion of the cutout closest to a bottom side edge of the pillow body. The bottom side extends away from the vertex at an angle from the bottom side edge. Each of the cutouts is further defined by a support portion of the pillow body that extends into each respective cutout between the top lobe and side lobe of each respective cutout, and which is positioned to correspond with the user's temple.

In accordance with another feature, an embodiment of the present invention further includes at least one ventilation channel between at least one of the pair of cutouts to a side of the pillow body.

Although the invention is illustrated and described herein as embodied in a pillow having pressure-relieving cutouts, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

"In the description of the embodiments of the present invention, unless otherwise specified, azimuth or positional relationships indicated by terms such as "up", "down", "left", "right", "inside", "outside", "front", "back", "head", "tail" and so on, are azimuth or positional relationships based on the drawings, which are only to facilitate description of the embodiments of the present invention and simplify the description, but not to indicate or imply that the devices or components must have a specific azimuth, or be constructed or operated in the specific azimuth, which thus cannot be understood as a limitation to the embodiments of the present invention. Furthermore, terms such as "first", "second", "third" and so on are only used for descriptive purposes, and cannot be construed as indicating or implying relative importance.

In the description of the embodiments of the present invention, it should be noted that, unless otherwise clearly defined and limited, terms such as "installed", "coupled", "connected" should be broadly interpreted, for example, it may be fixedly connected, or may be detachably connected, or integrally connected; it may be mechanically connected, or may be electrically connected; it may be directly connected, or may be indirectly connected via an intermediate medium. As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. Those skilled in the art can understand the specific meanings of the above-mentioned terms in the embodiments of the present invention according to the specific circumstances. As used herein, the term "respective" refers to a unique one of a plurality of similar structures or items. Thus, for example, each of a plurality of claims of this application has a respective claim number.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
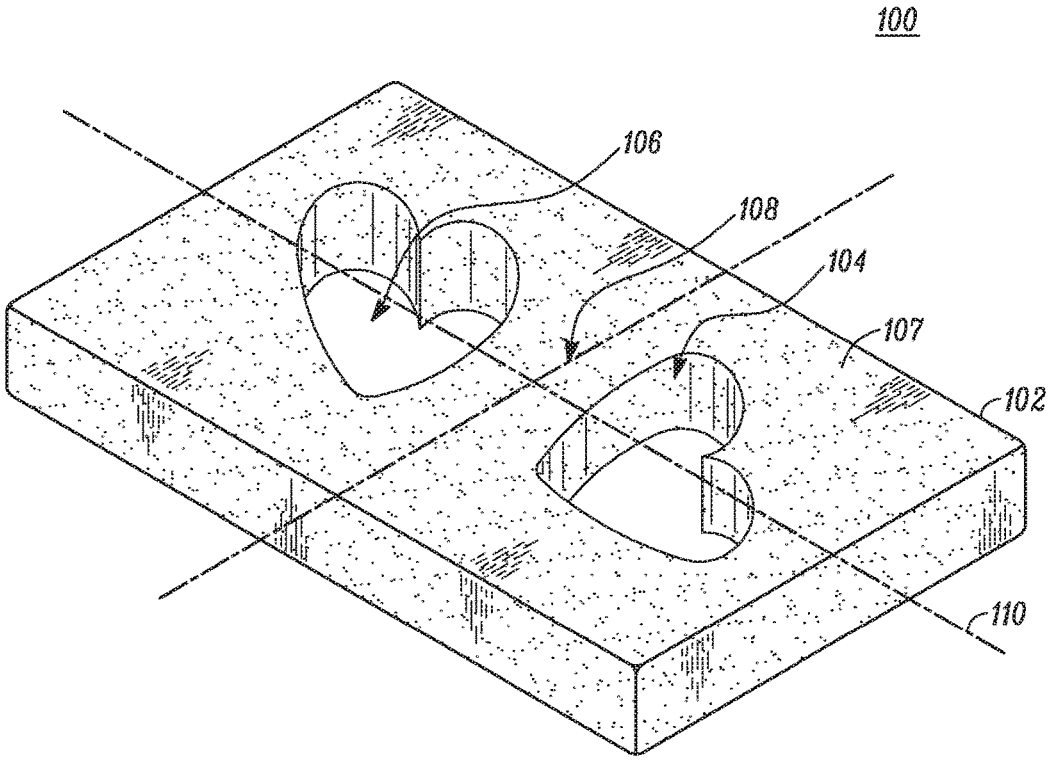
FIG. 1 is a perspective view of a surgical recovery pillow having at least one pressure-relieving cutout, in accordance with some embodiments.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and effective surgical recovery pillow for patients who have undergone facial and neck surgery. Referring now to FIG. 1, there is shown therein a perspective view of a surgical recovery pillow 100 having at least one pressure-relieving cutout, in accordance with some embodiments. The surgical recovery pillow is designed to accommodate the portions of a person's face and neck where surgical incisions and other surgical procedures are performed, particularly around the ear, eye, and neck areas, and to prevent pressure, such as would be experienced using a conventional pillow, to be experienced at these locations. By relieving pressure, and still providing sufficient support for the user's head, the effect of laying on the surgical recovery pillow will avoid stressing areas that are healing, while still providing a comfortable experience while sleeping. Furthermore, for people who have not undergone surgery, the pressure relief provided by the surgical recovery pillow 100 and similar embodiments can reduce the tendency to create wrinkles in the user's facial skin that would otherwise occur using a conventional pillow.

The surgical recovery pillow 100 includes a surgical recovery pillow body 102 which is generally formed of a compressible material, such as a foam fillings, or other materials, as is conventional. In some embodiments the body can be comprised of a resilient foam material, and in some embodiments the body can be comprised of a fabric outer covering that is filled with material. One or more depressions or cutouts 1 106 can be formed at a top surface 107, and extended downwards towards a bottom surface, which is opposite the top surface 107. The term "cutout" is used here to refer to a portion of the surgical recovery pillow body 102 lacking the material of the surgical recovery pillow body 102, and is not necessarily meant to imply that cutting is necessary to form these portions. The "cutout" areas can be formed, for example, as part of a molding process, or by joining top and bottom fabric portions that lack fabric in the cutout areas. In some embodiments, as shown here, the cutouts 104, 106 pass entirely through the surgical recovery pillow body 102, from the top surface 107 to the bottom surface. In some embodiments the cutouts 104, 106 extend only partially through the surgical recovery pillow body 102 from the top surface 107. When two cutouts are provided, as shown here with cutouts 104, 106, they can be formed symmetrically with respect to each other about a central line 108 (i.e. mirror images of each other). In general, the central line 108 passes in a general direction in which the user's body extends away from the surgical recovery pillow 100 when normally used, and is perpendicular to cross line 110. As a result, for example, cutout 104 can provide pressure relief for the left side of the user's face when, for example, the user is laying on their left side. Likewise, cutout 106 can provide pressure relief for the right side of the user's face when the user is laying on their right side. The portion of the surgical recovery pillow body 102 between the cutouts 104, 106 can provide support for the back of the user's head when the user is laying on their back. The cutouts 104, 106 can be generally heart-shaped, to correspond with, and to provide relief around user's ear, eye, and upper neck, while providing support on the user's temple and jaw. In embodiments where only one cutout is provided, the cutout can pass entirely through the surgical recovery pillow body 102 so that the user can simply turn the surgical recovery pillow 100 over to use with the other side of their face.

Figure 2:
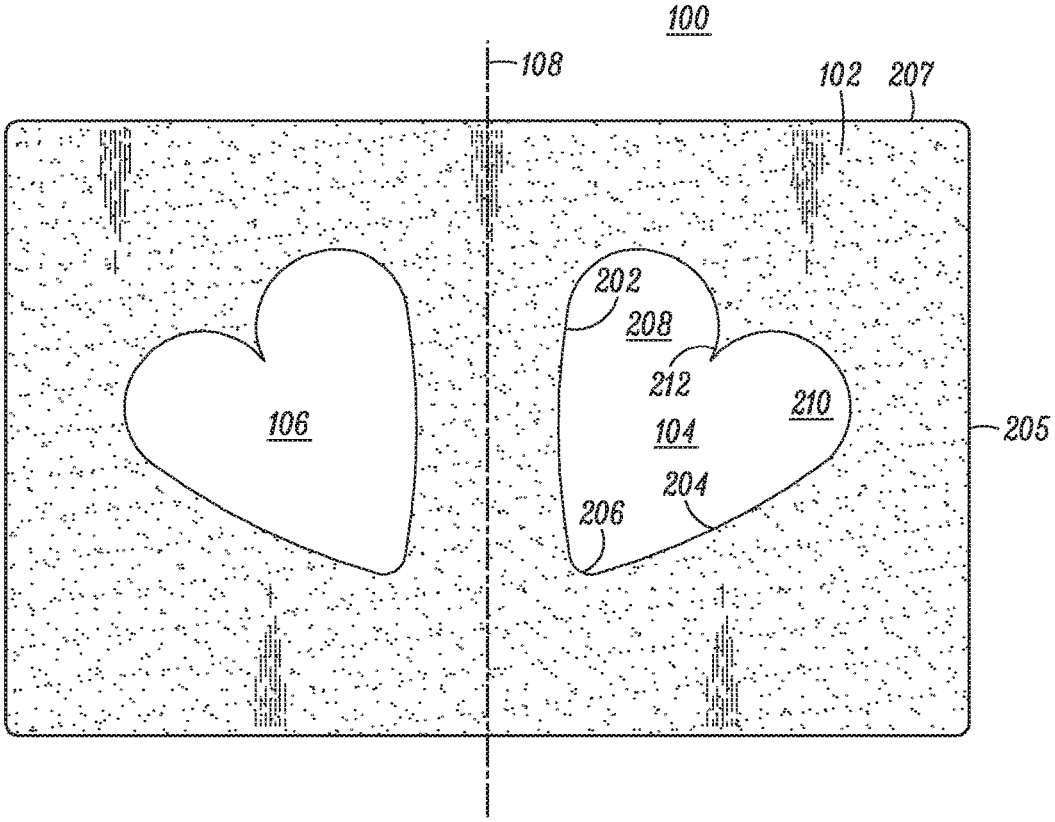
FIG. 2 is an overhead plan view of a surgical recovery pillow having pressure-relieving cutouts, in accordance with some embodiments.

FIG. 2 is an overhead plan view of the surgical recovery pillow 100 of FIG. 1, having pressure-relieving cutouts 104, 106, in accordance with some embodiments. The cutouts 104 and 106, as shown here, are identical, and are arranged to be symmetric about the central line 108. Note that the central line 108 is defined as a line along the general direction which a user's body extends away from the surgical recovery pillow 100 during use. The central line 108 is not necessarily related to the shape of the perimeter of the surgical recovery pillow 100 as the surgical recovery pillow 100 can be configured in a wide variety of shapes with different numbers of sides, including geometrically irregular shapes. The portions of cutouts 104, 106 are now described with reference to cutout 104, but the terms used to describe cutout 104 apply equally to the corresponding portions of cutout 106.

The cutouts 104, 106 each include a proximate side 202 and a bottom side 204, which meet at a vertex 206. The sides 202, 204 are generally linear, but can be somewhat arcuate. The proximate side 202 runs in a direction generally parallel to the central line 108, while the bottom line extends away from the vertex 206 towards an outside edge 205, and upwards towards an upper edge 207, at an angle from a line perpendicular to the central line 108. The cutouts 104, 106 further define an upper lobe 208 and a side lobe 210 that are contiguous with a major portion of the cutout, but which are also defined by a support portion 212 which extends into the cutout 104, 106 from the surgical recovery pillow body 102 between the top lobe 208 and the side lobe 210.

The top lobe 208 is configured and sized to correspond with the user's ear and surrounding region where surgical incisions are commonly made, and the proximate side 202 extends down the user's neckline such that the area which the main portion of the cutout 104 relieves is positioned in correspondence with the user's upper neck and the rear side of the user's jaw. The side lobe 210 is configured and sized to correspond with side of the user's face around the user's eye. The support portion 212 is configured to correspond with and provide support at the user's temple, to help support the user's head while positioned over the cutout 104. The bottom side 204, being angled up, generally traverses along a line from the user's neck up to the front of cheek, such that the user's lower jaw, towards the front of the user's face, is supported by the material of the surgical recovery pillow body 102.

Figure 3:
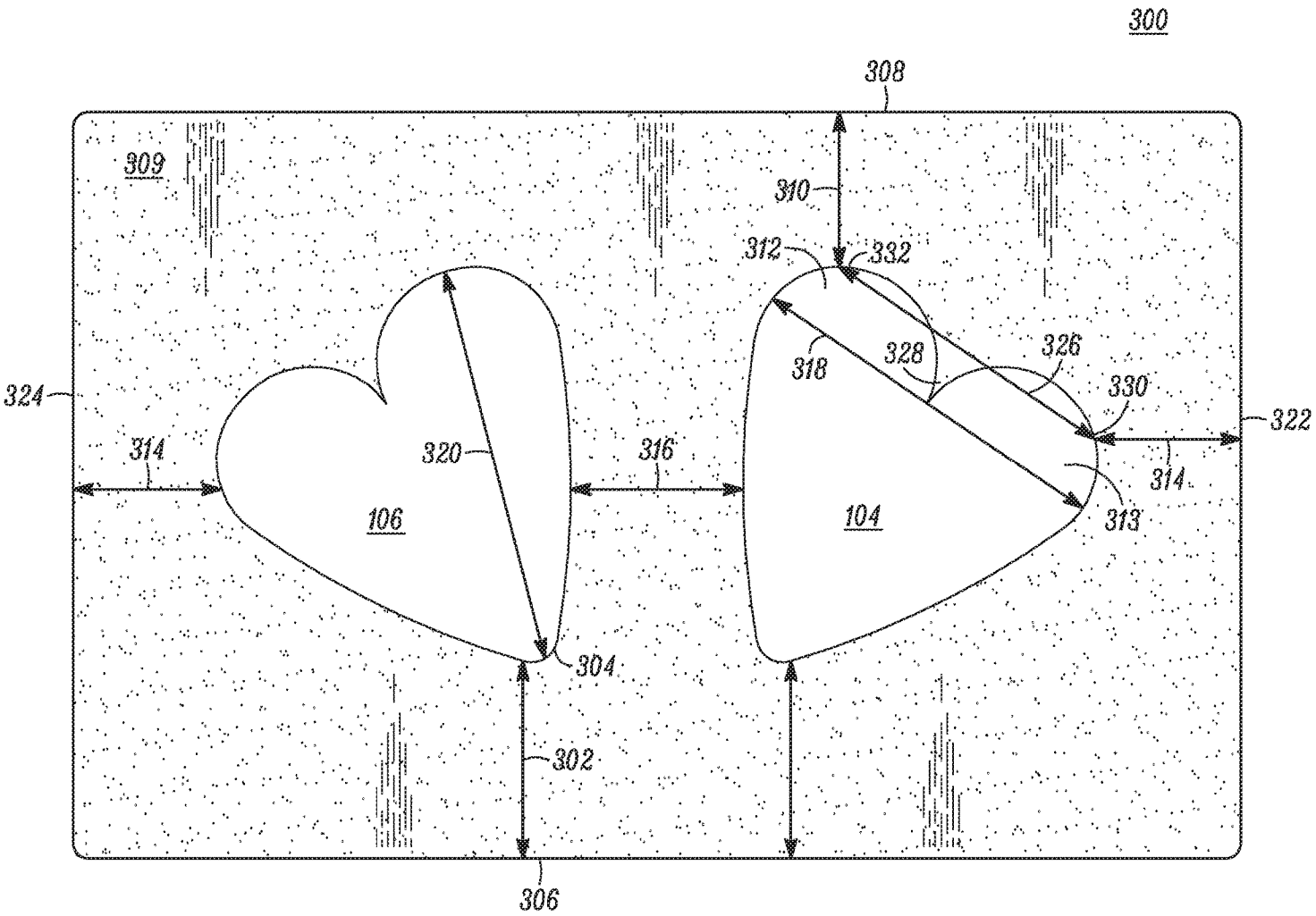
FIG. 3 is an overhead plan view of a surgical recovery pillow having pressure-relieving cutouts, in accordance with some embodiments.

FIG. 3 is an overhead plan view of a surgical recovery pillow 300 having pressure-relieving cutouts 104, 106, in accordance with some embodiments. Embodiments represented by FIG. 3 generally include the surgical recovery pillow 300 being rectangular in shape, having a lower outside edge 306, upper outside edge 308, and right and left outside edges 322, 324, respectively. As shown here the view shows the top surface 309, but it could equally be the bottom surface, assuming the cutouts 104, 106 pass entirely through the surgical recovery pillow 300. For the sake of example, the view in FIG. 3 is of the top surface 309 of the surgical recovery pillow 300, and the bottom surface is under the top surface 309. But as used here, the relational terms referring to the side edges, e.g. "upper," "lower, "left" and "right," are with respect to the two dimensional view of the surgical recovery pillow 300 on the page as shown in FIG. 3; thus the upper outside edge 308 is the outside edge of the side of the surgical recovery pillow closest to the top of the page, the lower outside edge 306 is the outside edge of the side of the surgical recovery pillow closest to the bottom of the page, and so on.

The cutouts 104, 106 are positioned in the surgical recovery pillow 300 such that a distance 302 from the vertex 304 of each cutout 104, 106, at a point closest to the lower outside edge 306, to the lower outside edge 306 is less than the distance 310 from the top lobe, at a point 332 closest to the upper outside edge 308, to the upper outside edge 308. In some embodiments distance 302 is less than two inches, and distance 310 is greater that two inches. In some embodiments, distance 302 can be about one and three quarter inches, and distance 310 can be about two and three eighths inches. The greater length of distance 310 over distance 302 provides support for the upper head when the side of the user's face is properly positioned over the cutouts 104, 106, while distance 302 ensures that the surgical recovery pillow is not pressing against the lower neck or into the user's shoulder.

The distance 314 from the side lobe 313, at a point 330 closest to the side outside edge 322, to the side outside edge 322 can be at least one inch, and in some embodiments it can be one and a half inches to ensure there is sufficient support for the user's lower jaw. The closest distance 316 between the cutouts 104, 106, and in particular, between the proximate sides of the cutouts 104, 106, can be at least two inches, and in some embodiments it can be about two and a half inches. The distance 316 is intended to be wide enough to comfortably rest the back of the user's head when the user is laying on their back. Distance 320 from the vertex 304 to the top lobe nearest the upper outside edge 308 can be at least five inches, and in some embodiments about five and half to six inches. Distance 318 from top lobe 312 to the side lobe 313, at the widest point without passing over the support portion 328 can be five to six inches, and in some embodiments about five and half inches. A line 326, from the side lobe 313 at point 330 to the top lobe at point 332 passes over the support portion 328, indicating that the support portion 328 at least partially defines the top lobe 312 from the side lobe 313, while both the top lobe 312 and side lobe 313 are contiguous with the main portion of the cutouts 104, 106 in each cutout. In general, the various dimensions of the cutouts 104, 106 are sized to correspond generally with the indicated features of a person's face/neck when laying with the side of their face and neck positioned over a cutout 104, 106. Around the cutouts 104, 106, the material of the surgical recovery pillow body provides support to the parts of the user's face where pressure does not need to be relieved, ordinarily, for certain surgical procedures.

Figure 4:
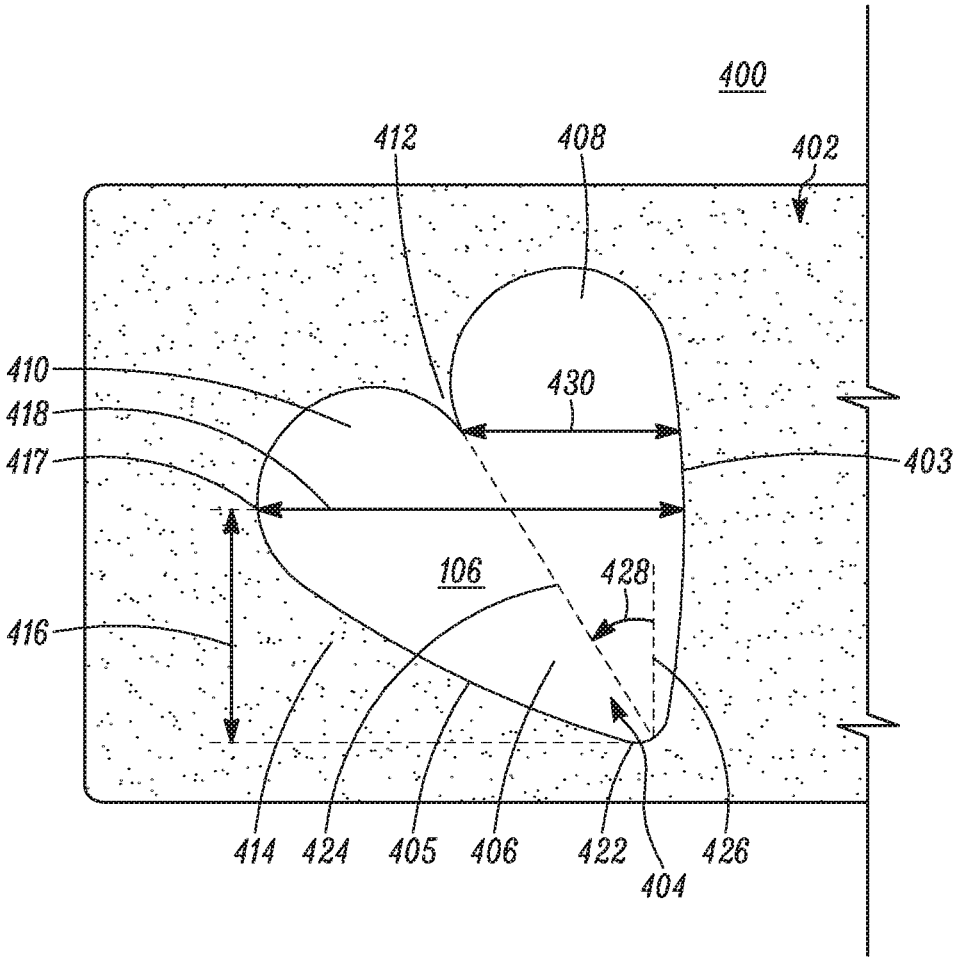
FIG. 4 is an bottom plan view of a detail of a pressure-relieving cutout, in accordance with some embodiments.

FIG. 4 is a bottom plan view of a detail of a surgical recovery pillow 400 having a pressure-relieving cutout 404, in accordance with some embodiments. The cutout 404 can correspond with cutout 104 of FIG. 1, and is formed in the surgical recovery pillow body 402. A main portion 406 of the cutout 404 begins at a vertex 422 where the proximate side 403 and the bottom side 405 meet, and extends towards the top lobe 408 and the side lobe 410. The vertex 422 can be rounded or pointed. The top lobe 408 and side lobe 410 are further defined by a support portion 412 that is a portion of the surgical recovery pillow body 402 that extends into the cutout 404 between the top lobe 408 and side lobe 410. The bottom side 405 extends from the vertex 422 to the side and up to a point 417 of the side lobe 410 closest to the outside edge of the surgical recovery pillow 400, which is a distance 416 of about two to three inches. Point 417 is at a position relative to the proximate side 403 about halfway between highest point (on the page) of the top lobe 408 and the vertex 422, with a tolerance of about one half inch. The distance 418 across the cutout 404 horizontally from point 417 to the proximate side 403 can be four to six inches. The distance 430, horizontally, from the proximate side 403 to a tip of the support portion 412 can be about two to three inches. The cutout 404 can be symmetric about a line 424 from the vertex 422 to the tip of the support portion 412, and the line 424 can be at an angle 428, with respect to a vertical line 426 (in the same direction as line 108 of FIGS. 1 & 2), of about 40 to 60 degrees.

Figure 5:
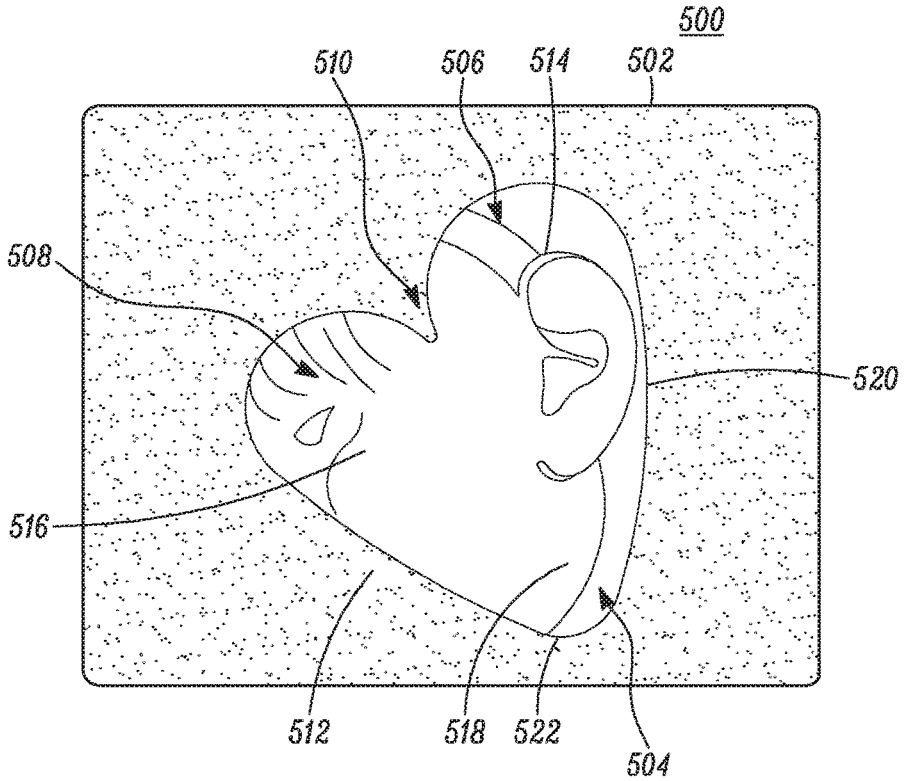
FIG. 5, is an underside plan view of detail of a user using a surgical recovery pillow having pressure-relieving cutouts, in accordance with some embodiments.

FIG. 5, is an underside plan view of a surgical recovery pillow 500 showing a detail view of a user laying on the surgical recovery pillow body 502, over a pressure-relieving cutout 504, in accordance with some embodiments. In particular, the cutout 504 can be identical to cutout 404 of FIG. 4, and shows a user's face properly positioned over the cutout 504. The cutout 504 includes a top lobe 506 and side lobe 508 which are separated and partially defined by a support portion 510. A portion 512 of the surgical recovery pillow 502 under the bottom side of the cutout 504 supports the forward portion of the user's lower jaw and chin, which as a result cannot be seen in this view. The user's ear 514 is positioned partially in the top lobe 506, and the support portion 510 extends inwards into the cutout 504 to support the user's head at the temple region. The user's eye region 516 is positioned in correspondence with the side lobe 508. The user's upper neck 518, under the ear 514 and behind the jaw, is within the main portion of the cutout, near the proximate side 520 and the vertex 522. As shown, the user's head is supported all around the user's face, and the cutout 504 relieves pressure around the user's ear, upper neck, cheek, and eye regions, which can greatly aid in allowing surgical incisions and trauma to heal without being affected by pressure that would otherwise be experienced when the user lay on their side. Further, even for persons who are not in recovery, over time the areas where pressure is relieved may develop fewer or less wrinkles that would otherwise be induced in the skin if the pressure was not relieved in these areas of the face.

The surgical recovery pillow of the inventive embodiments is especially useful for patients who have undergone platymaplasty surgery, referred to as a "neck lift," which is a procedure that is performed when a patient's central neck platysma muscle is significantly diastatic, revealing deep neck bands due to the muscle being pulled apart in the midline. This condition becomes apparent as a person ages, generally, due to the connective tissue and underlying skin losing elasticity. Platysmaplasty surgery, also commonly known as 'corset platysmaplasty,' is a type of neck lift surgery that addresses these muscles, specifically tightening and reconstructing the platysma muscle to repair the loose sagging or banding skin on the neck. The procedure rejuvenates the neck, restoring it to a more aesthetically pleasing shape and contour. Recovery after surgery typically requires the patient to lie on their back (supine) while sleeping to avoid putting weight/pressure on the areas affected by the surgery. This can be a considerable challenge for people who are used to sleeping on their side. Typically, by about six months after the procedure is performed, as well as for related procedures such as facelift, and other neck lifts, most of the swelling and scarring will have resolved. For the next six months the skin and muscles will continue to heal, and remain sensitive to pressure as the body's collagen healing goes through reconfiguration. Lumps resulting from submandibular glands or lymph nodes that may have been affected by the surgery will diminish if allowed to heal without undue pressure. Patients can try to fall asleep in the supine position, but while asleep they may roll to their side. The cutouts of the inventive surgical recovery pillow as disclosed herein avoid pressure being evident on these sensitive areas that are healing, and the surrounding material of the surgical recovery pillow around the cutouts will still provide adequate support for the head while the patient sleeps.

Figure 6:
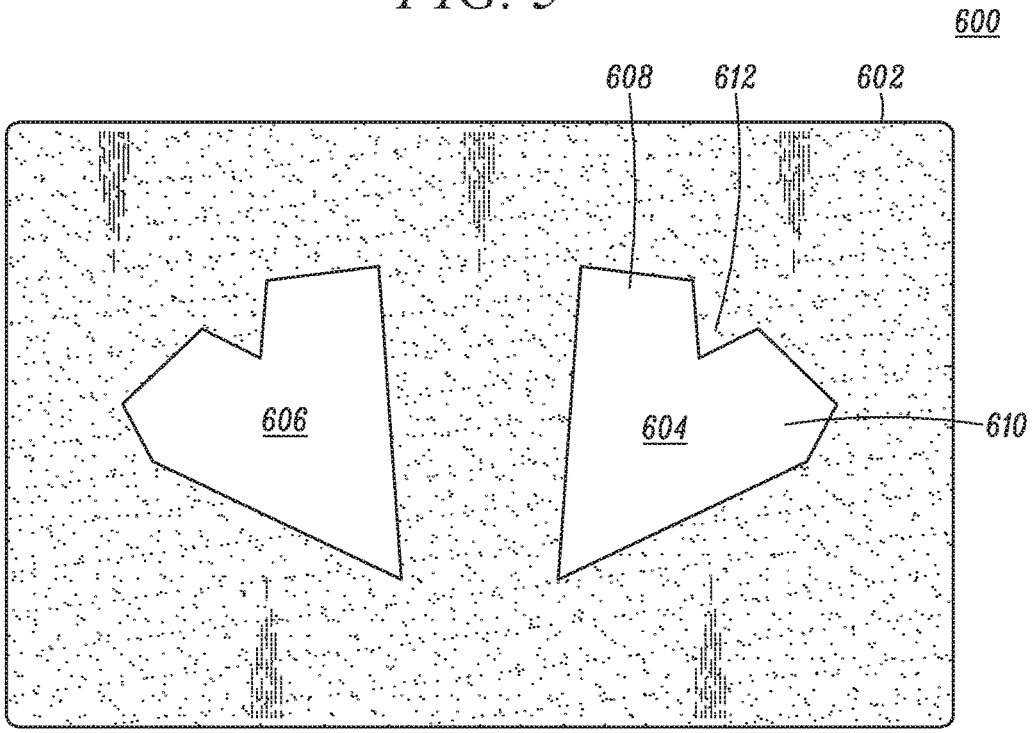
FIG. 6 is an overhead plan view of a surgical recovery pillow having pressure-relieving cutouts, in accordance with some embodiments.

FIG. 6 is an overhead plan view of a surgical recovery pillow 600 having pressure-relieving cutouts 604, 606 in the surgical recovery pillow body 602, in accordance with some embodiments. FIG. 6 illustrates an alternative shape to the heart-shaped cutouts exemplified in FIGS. 1-5. Generally, the cutouts have a top lobe 608 and a side lobe 610 and a support portion 612 that extends into the cutout 604 between the top lobe 608 and the side lobe 610. The cutouts 604, 606 are squared and angular, unlike the heart-shaped cutouts of FIGS. 1-5, but function the same in relieving pressure at critical positions of the user's face when the user's face is properly positioned over the cutouts 604, 606.

It will be further appreciated by those skilled in the art that the cutout or cutouts, as mentioned, do not need to pass entirely through the surgical recovery pillow body. In some embodiments the cutouts can be more of a depression or recess in the top surface of the body of the pillow, and can have a uniform depth from the top surface into the pillow body that is on the order of one inch. In some embodiments the cutout or cutouts can have a varying depth depending on the location in the cutout. For example, the top lobe of the cutout can be deeper that the side lobe since more weight from the user's head will be over the top lobe, compressing the material around the top lobe more. In some embodiments the pillow body can be formed in two or more layers with an upper layer of resilient material that is stiffer than a lower layer, to help support the user's head around the edges and sides of the cutouts.

Figure 7:
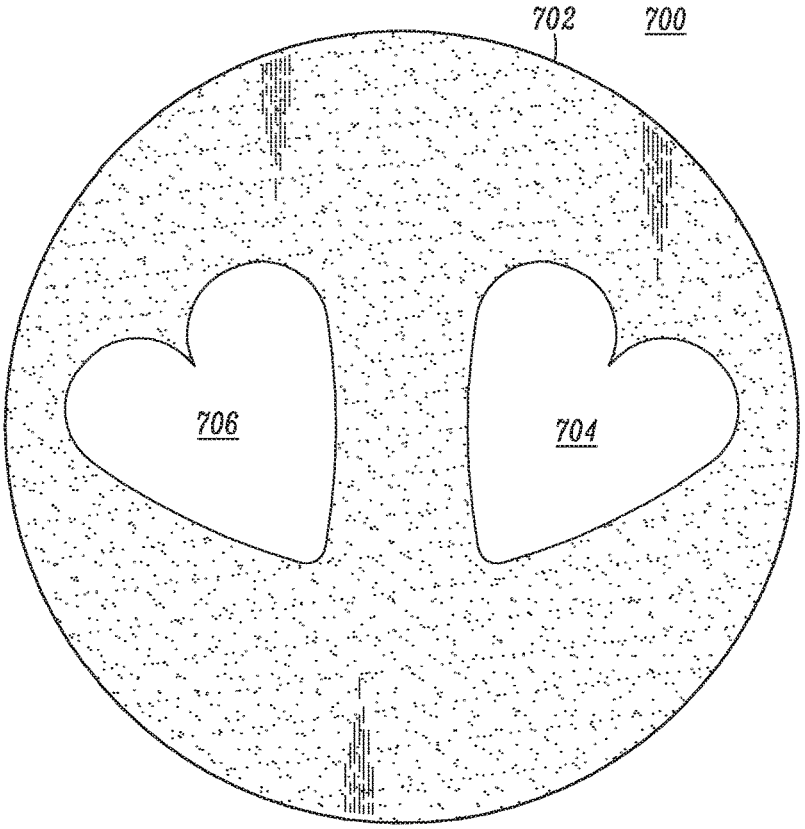
FIG. 7 is an overhead plan view of a surgical recovery pillow having pressure-relieving cutouts, in accordance with some embodiments.

FIG. 7 is an overhead plan view of a surgical recovery pillow 700 having pressure-relieving cutouts 704, 706 in the surgical recovery pillow body 702, in accordance with some embodiments. The surgical recovery pillow 700 illustrates that the surgical recovery pillow 700 can have different perimeter shapes other than a rectangle. In fact the surgical recovery pillow can have an irregular or arbitrary perimeter shape. Again, two cutouts 704, 706 are shown, but only one may be necessary if a cutout goes entirely through the pillow, as the surgical recovery pillow 700 can be flipped over (e.g. top surface becomes bottom surface).

Figure 8:
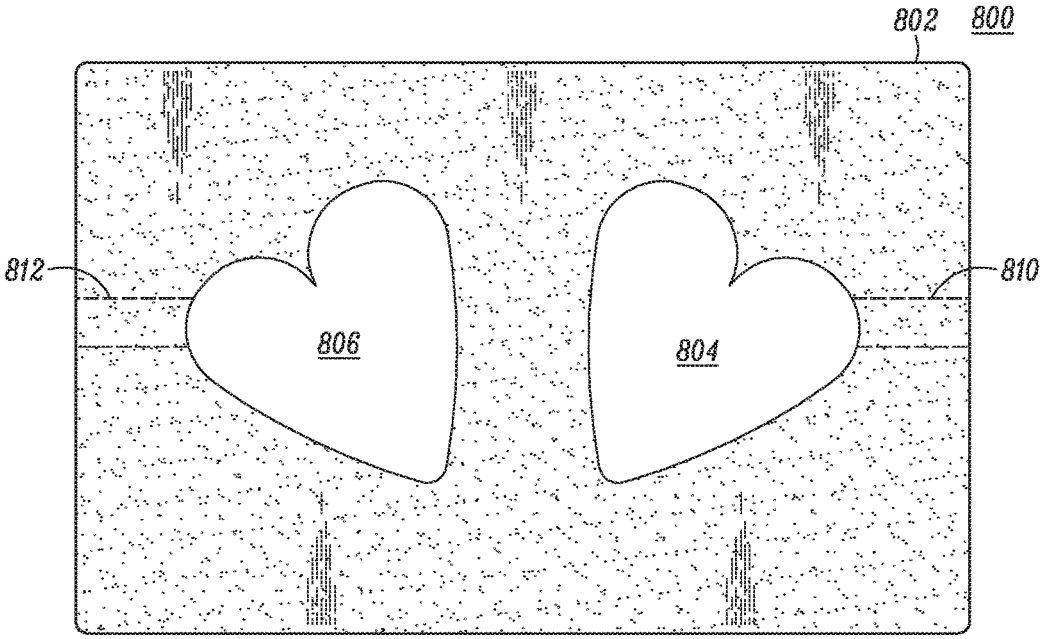
FIG. 8 is an overhead plan view of a surgical recovery pillow having pressure-relieving cutouts with ventilation channels, in accordance with some embodiments.

FIG. 8 is an overhead plan view of a surgical recovery pillow 800 having pressure-relieving cutouts 804, 806 in the surgical recovery pillow body 802 with ventilation channels 810, 812, in accordance with some embodiments. The ventilation channels 810, 812 are passages formed in the surgical recovery pillow body 802, from a side of the surgical recovery pillow body 802 to the cutouts 804, 812, respectively. In particular the channels 810, 812 join to the cutouts 804, 806 at the side lobes of the cutouts in the present example. The channels 810, 812 can allow air circulation through the cutouts 804, 806, which can aid in cooling the user's face, as well as to facilitate healing of surgical incisions.

Figure 9:
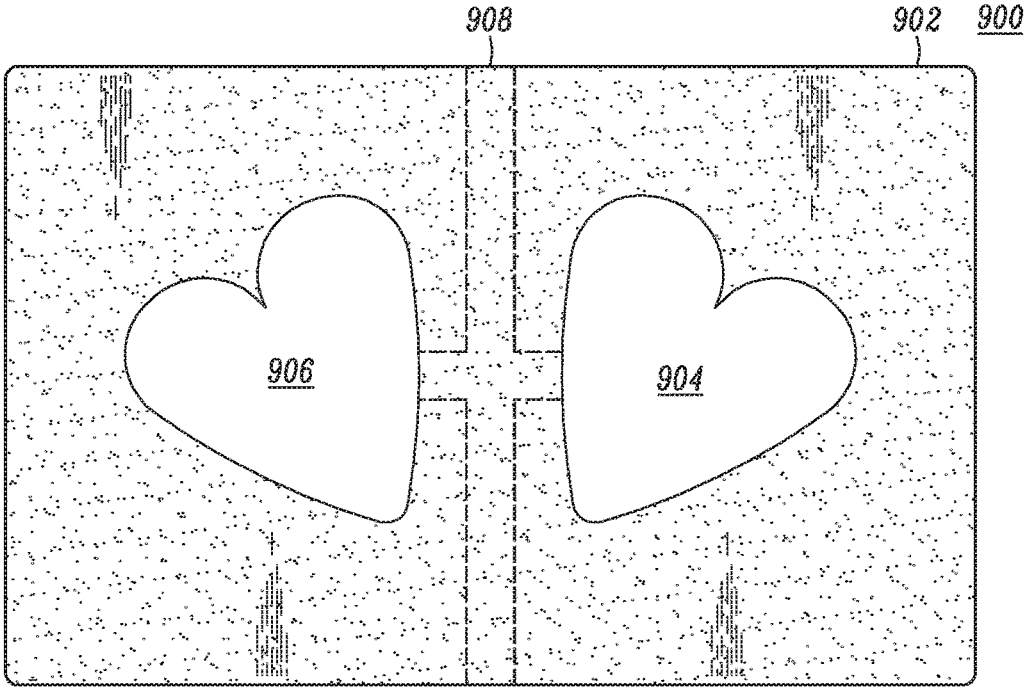
FIG. 9 is an overhead plan view of a surgical recovery pillow having pressure-relieving cutouts with ventilation channels, in accordance with some embodiments.

FIG. 9 is an overhead plan view of a surgical recovery pillow 900 having pressure-relieving cutouts 904, 906 in surgical recovery pillow body 902 with ventilation channels 908, in accordance with some embodiments. In this example the ventilation channel 908 or channels connect to the cutouts 904, 906 at the proximate sides of the cutouts 904, 906, and join to the upper and/or lower outside edges of the surgical recovery pillow body 902. The channel 908, being an absence of material in the surgical recovery pillow body, can result in a slight pressure relief between the cutouts 904, 906, such as when the user places the back their head between the cutouts 904, 906, which can help stabilize the user's head between the cutouts.

Figure 10:
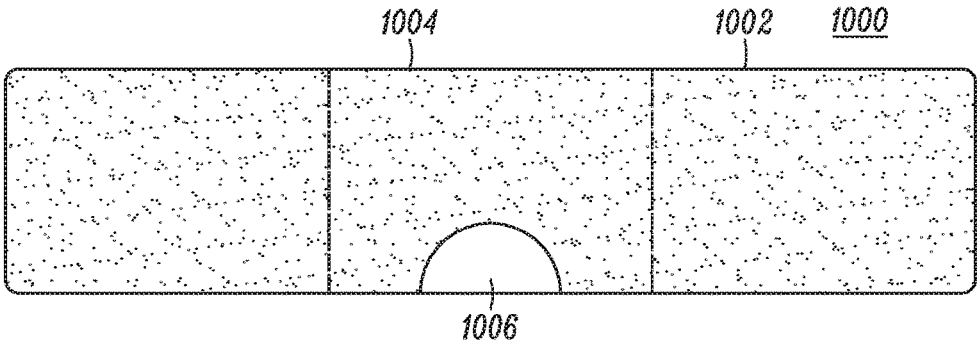
FIG. 10 is a side elevational view of a surgical recovery pillow having pressure-relieving cutouts at least one ventilation channel, in accordance with some embodiments.

FIG. 10 is a side elevational view of a surgical recovery pillow 1000 having pressure-relieving cutouts, such as cutout 1004 in surgical recovery pillow body 1002, and at least one ventilation channel 1006, in accordance with some embodiments. The channel 1006 is a passage with an opening at the side of the surgical recovery pillow body, and which extends through the surgical recovery pillow body to connect with the cutout. From the side view the surgical recovery pillow has a height or thickness which can be on the order of one to four inches in some embodiments.

Accordingly, the surgical recovery pillow disclosed herein solves the problems associated with the prior art by avoiding pressure being evident around the ear, eye, cheek, and upper neck regions at the side of a user's face, while still providing adequate support around the cutout to support the user's head comfortably while laying on their side. By using a pillow constructed in accordance with inventive embodiments disclosed herein, a facial surgery patient can facilitate healing of the areas affected by the surgery without stressing the skin and tissue of those areas. The shape of the cutout or cutouts, because of the need to support the front of the jaw, and the temple region of the user's head, can generally correspond to a heart shape that is tilted. Since the user's face is generally symmetric, two such cutouts can be provided that are symmetric (e.g. mirror images) with respect to each other for the left and right sides of the user's face.

What is claimed is:

1. A facial surgery recovery pillow, comprising:

a pillow body having an outside edge around a perimeter of the pillow body; and a pair of cutouts formed at a top surface of the pillow body and extending from the top surface towards a bottom surface of the pillow body, the cutouts being positioned symmetrically on the top surface with respect to each other, each of the cutouts defining a proximate side and a bottom side, the proximate side and bottom side meeting at a vertex with the bottom side extending away from the proximate side towards an outside edge of the pillow body at an angle from a bottom edge of the pillow body, each of the cutouts further defining a top lobe and a side lobe with a support portion of the pillow body extending in between the top lobe and the side lobe;

wherein each of the cutouts are substantially heart-shaped being symmetric about a line between a peak of the support portion and the vertex, and wherein the line between the peak of the support portion and the vertex is at an angle of between 40 and 50 degrees with respect to an axis about which the cutouts are symmetric.

2. The facial surgery recovery pillow of claim 1, wherein the pair of cutouts are separated between their respective proximate sides by a distance of at least two inches.

3. The facial surgery recovery pillow of claim 1, wherein the pillow body is formed of a resilient foam.

4. The facial surgery recovery pillow of claim 1, wherein a distance from the respective vertex of each cutout to a lower outside side edge of the pillow body is less than a distance from the respective top lobe of each cutout to an upper outside edge of the pillow body.

5. The facial surgery recovery pillow of claim 4, wherein the distance from the respective vertex of each cutout to the lower outside edge of the pillow body is not more than two inches, and the distance from the respective top lobe of each cutout to the upper outside edge of the pillow body is more than two inches.

6. The facial surgery recovery pillow of claim 1, wherein the top and bottom surfaces of the pillow body are rectangular.

7. The facial surgery recover pillow of claim 1, further comprising a ventilation channel formed in the pillow body between at least one of the cutouts and an outer edge of the pillow body.

8. The facial surgery recovery pillow of claim 1, wherein the cutouts pass completely through the pillow body, from the top surface of the pillow body to the bottom surface of the pillow body.

9. A surgical recovery pillow for facilitating healing of a user after facial and neck surgical procedures by avoiding pressure on portions of a side of a face of the user, the surgical recovery pillow comprising:

a pillow body having an outside edge around a perimeter of the pillow body;

a pair of substantially heart shaped cutouts formed in the pillow body which are arranged symmetrically with respect to each other, each of the substantially heart-shaped cutouts:

is formed at a top surface of the pillow body and extends from the top surface towards a bottom surface of the pillow body;

defines a proximate side and a bottom side, the proximate side and bottom side meeting at a vertex with the bottom side extending away from the proximate side towards an outside edge of the pillow body at an angle from a lower outside edge of the pillow body, the proximate side being substantially parallel to a centerline between a upper outside edge of the pillow body and the lower outside edge of the pillow body, the pair of heart-shaped cutouts being symmetric about the centerline; and defines a top lobe and a side lobe with a support portion of the pillow body extending in between the top lobe and the side lobe, and a main portion joining the top lobe and the side lobe and extending down to the vertex, the top lobe being sized and configured to correspond to an ear of the user, the side lobe being sized and configured to correspond to an eye of the user, the main portion being sized and configured to correspond to an upper neck portion of the user, and the support portion having a portion corresponding to a temple of the user, between the ear and eye of the user when the user lays with the side of the user's face over the at least one cutout with the user's ear positioned in the top lobe, the user's eye positioned in the side lobe, and the user's upper neck positioned in the main portion and wherein the bottom side of the cutout follows a line from the vertex to the side lobe away from the lower outside edge.

10. The surgical recovery pillow of claim 9, wherein the pillow body is formed of a resilient foam.

11. The surgical recovery pillow of claim 9, wherein a distance from the vertex to the lower outside side edge of the pillow body is less than a distance from the top lobe to the upper outside edge of the pillow body for each of the substantially heart-shaped cutouts.

12. The surgical recovery pillow of claim 11, wherein, for each of the substantially heart-shaped cutouts, the distance from the vertex to the lower outside edge of the pillow body is not more than two inches, and the distance from the top lobe to the upper outside edge of the pillow body is more than two inches.

13. The surgical recovery pillow of claim 9, wherein each of the substantially heart-shaped cutouts is symmetric about a line between a peak of the support portion and the vertex, and wherein the line between the peak of the support portion and the vertex is at an angle of between 40 and 50 degrees with respect to an axis from a top edge to a bottom edge of the pillow body.

14. The surgical recovery pillow of claim 9, wherein the top and bottom surfaces of the pillow body are rectangular.

15. The surgical recover pillow of claim 9, further comprising a ventilation channel formed in the pillow body between the at least one cutout and an outer edge of the pillow body.

16. The surgical recovery pillow of claim 9, wherein each of the substantially heart-shaped cutouts pass completely through the pillow body, from the top surface of the pillow body to the bottom surface of the pillow body.

17. The surgical recovery pillow of claim 9, wherein substantially heart-shaped cutouts are separated between their respective proximate sides by a distance of at least two inches.

18. A surgical recovery pillow, comprising:

a pillow body formed of a resilient foam material having a top surface and a perimeter including side edges; and a pair of cutouts formed in the top surface of the pillow body which are positioned symmetrically at the top surface of the pillow body, each cutout having a main portion, a top lobe, and a side lobe, the top lobe configured to correspond with a user's ear, the side lobe configured to correspond with an eye of the user, and the main portion configured to correspond with a cheek and upper neck of the user;

wherein each of the cutouts is defined in part by a respective proximate side and a respective bottom side, the proximate side of each cutout being substantially in line with a direction in which the user lays with respect to the surgical recovery pillow, and the bottom side meeting the proximate side at a vertex at a portion of the cutout closest to a bottom side edge of the pillow body, the bottom side extending away from the vertex at an angle from the bottom side edge toward a top side edge of the surgical recovery pillow to a point of the respective cutout nearest an outside edge of the surgical recovery pillow that is approximately halfway between a highest point of the top lobe toward the top outside edge of the surgical recovery pillow and the vertex; and each of the cutouts being further defined by a support portion of the pillow body that extends into each respective cutout between the top lobe and side lobe of each respective cutout, and which is positioned to correspond with a temple of the user when the user lays on the surgical recovery pillow with a side of the user's face one of the cutouts such that the user's eye positioned over the side lobe, the user's ear positioned over the top lobe, and the user's upper neck and cheek positioned over the main portion.

19. The surgical recovery pillow of claim 18, further comprising at least one ventilation channel between at least one of the pair of cutouts to a side of the pillow body.

20. The surgical recovery pillow of claim 18, wherein each of the cutouts are substantially heart-shaped being symmetric about a line between a peak of the support portion and the vertex, and wherein the line between the peak of the support portion and the vertex is at an angle of between 40 and 50 degrees with respect to an axis about which the cutouts are symmetric.

* * * * *